US005759043A

United States Patent [19]

Craig

[11] Patent Number: 5,759,043

[45] Date of Patent: Jun. 2, 1998

[54] PHYSICAL EXERCISE MANAGEMENT PLANNER, METHOD OF ITS USE, AND DEVICE

[76] Inventor: Duane J. Craig, 5715 W. Atlantic Pl. #202, Lakewood, Colo. 80227

[21] Appl. No.: 540,191

[22] Filed: Oct. 6, 1995

[51] Int. Cl.[6] ..... A63B 69/00; G09B 19/00; G09B 25/00; G09B 29/00

[52] U.S. Cl. ..... 434/247; 434/257; 434/428; 434/430; 434/429; 434/392; 273/298; 273/302; 273/308; 40/124.01

[58] Field of Search ..... 434/257, 428, 434/430, 247, 429, 392; 273/298, 302, 308; 40/124.01

[56] References Cited

U.S. PATENT DOCUMENTS

| | | | |
|---|---|---|---|
| 3,791,059 | 2/1974 | Shneider . | |
| 3,968,573 | 7/1976 | Poliniere . | |
| 4,011,671 | 3/1977 | Fogel et al. | 35/7 R |
| 4,518,364 | 5/1985 | Jacobson . | |
| 4,976,622 | 12/1990 | Clark . | |
| 5,135,401 | 8/1992 | Feldman-Schorrig . | |
| 5,181,743 | 1/1993 | Lloyd . | |
| 5,197,763 | 3/1993 | Whalen . | |
| 5,205,591 | 4/1993 | Lorenz . | |
| 5,249,827 | 10/1993 | Olson . | |
| 5,263,865 | 11/1993 | Zipf . | |
| 5,338,202 | 8/1994 | Saari . | |
| 5,356,137 | 10/1994 | Carvalho | 273/73 R |
| 5,387,164 | 2/1995 | Brown . | |
| 5,410,472 | 4/1995 | Anderson . | |

OTHER PUBLICATIONS

The Anatomical Products Catalog, Anatomical Chart Co., pp. 44–46, 1992.

*Primary Examiner*—Richard J. Apley
*Assistant Examiner*—John Rovnak

[57] ABSTRACT

An exercise planner and method, in which a ringed binder contains a set of exercise cards, with each card showing a given exercise, the purpose of the exercise, describing the benefits of the exercise and how to perform it, and on the reverse of the card providing an easily erasable grid on which the user can record their workout progress. The order of the cards can be set in any desired arrangement so as to achieve a workout calculated to maximize the benefit to the user.

20 Claims, 2 Drawing Sheets

PHYSICAL EXERCISE MANAGEMENT PLANNER, METHOD OF ITS USE, AND DEVICE

BACKGROUND OF THE INVENTION

The present invention generally relates to the field of information presentation, especially for physical exercise and more particularly to a method for designing and effectively monitoring progress in exercise programs. In particular, the present invention relates to activity or exercise guidance and the creation, maintenance and modification of a personal exercise regimen that accounts for the personal goals, time constraints, and physicals abilities of the individual user.

Statement Of The Problem

In spite of the well-known benefits of physical exercise, it is estimated that only approximately 10% of the population gets a physical exercise workout on a regular basis. 25% of the population gets no exercise at all. Indeed, the population of overweight Americans has increased from 26% in 1980 to 34% at present. There are three primary barriers to initiating an exercise program, namely lack or knowledge, perceived lack of time and lack of motivation. Many individuals never get started on a workout program because they simply don't know how to go about setting up and carrying out such a program. Another common problem is that many individuals do get started on an exercise program, but they don't stay with the program to obtain its long-range benefits, either because they feel they don't have the time to commit to the program, or they get bored with the program, or they become frustrated out of a failure to realize the results they set out to achieve. Many people discover that time allotted to exercise is not as immediately attractive and gratifying as time allotted to other activities, such as watching television. This is reflected as an ingrained desired for quick gratification, evidenced by the large number of people who join a gym and quit after a relatively short period of time, such as a month, when they don't achieve immediate, gratifying results. An important aspect of maintaining motivation in an exercise program is to grasp the wider implications of the benefits of exercise, including weight loss, improvement of physical appearance, reduction of the risk of heart disease, increase in energy levels, and improvement in overall feeling of well being, as well as being able to grasp the interelationship between looking good and feeling good, since the exercises necessary to achieve one are the exercises necessary to achieve the other.

Prior art solutions typically include textbook instruction. The problem with this is a definite lack of flexibility and ability to customize and adapt the teachings of any given book to the individual needs or goals of a person. The same can be said of instructional classes, instructional videos or audio tapes, magazines, television programs, infomercials and the like. While any of these sources can provide primary instruction on the collection of exercises taught within them, they cannot conveniently be customized to the individual and made portable enough to take to the workout place conveniently. It is readily apparent that all of these media suffer from the shortcoming that it is not easily possible to add, deduct or rearrange their data. No one wants to tear the pages out of a book or magazine, or try to re-record and edit a tape in order to put together a customized exercise program. To be selective, data has to be selectively rewritten onto some other media, which is cumbersome and time consuming. Additionally, many of those things learned while reading, listening to or looking at such sources can be forgotten by the time the user's exercise workout begins.

The Solution To The Problem

The present invention overcomes the deficiencies of the prior art identified in the previous section through achievement of the following objectives. It is therefore an object of the present invention to provide a complete exercise guidance system designed to improve the efficiency and effectiveness of fitness programs. By the term "increased efficiency", I mean requiring less time to get an effective workout, through the following means: 1) by providing the user with information to structure a fitness program that works best for that person and still fits within their time constraints; 2) by providing a system of information cards on exercises and by providing a way of keeping a record directly on the information cards that will not ruin the cards, thus allowing the user to track their results and identify the exercises that work best for them, thus achieving quicker results because they can identify the exercises that produce results and avoid spending time on ineffective exercises, and once they can see results, experience a positive motivation effect; 3) by saving the user time on learning how to do a given exercise and preventing the wasting of time through performing the exercise ineffectively; 4) by permitting the user to monitor progress and acquire information needed to modify an exercise program to continually achieve maximal benefit and thereby receive positive reinforcement through a safe and sound progression; and 5) by providing a system of easily movable and sortable cards that allow the user to lay out a desired workout program ahead of time so that when they arrive at the gym, no time is wasted going through anything other than the exercises targeted for completion that day, and by making the cards and carrying means so portable that the user can easily and conveniently take the necessary information with that person to the workout place. Furthermore, it is an object of the invention to provide a practical, lightweight, durable, portable exercise trainer and instructional guide for exercise participants that they can take wherever needed, which remedies the limitations of exercise aids and guides presently in use. Additionally, it is an object to provide satisfaction to the user at being able to get actively involved with and customize their own exercise program. A further object is that an outcome based strategy is provided for producing a training effect in the shortest period to time. Another object of the invention is to provide users with a variety of exercises to help prevent boredom with an exercise program. Another object of the present invention is to aid users in improving their physique, overall health, and overall quality of life.

It is a feature of the invention to provide sound, effective fitness information that is presented in a simple and basic fashion that will be of use to beginning, intermediate and advanced fitness participants. The information is packaged in a manner that is easily stored and easily transportable from home to a gym or workout center or while traveling. Another feature of the invention is to provide the information in a format that stays open and easily viewable while exercising, and that is resistant to staining, and wear and tear.

SUMMARY OF THE INVENTION

In brief summary, the invention is a planner and method of using the planner. Use of the planner comprises the steps of: providing a storage means and a carrying means; providing a plurality of muscle group cards each describing a specific muscle group, each such muscle group being described and graphically identified by a predominant color tone, and each such card adapted to fit in said carrying means; providing a plurality of exercise cards, each describing and illustrating a specific exercise, each such card being graphically identified by a predominant color tone coordinated to one or more of said muscle group cards, and each such card adapted to fit in said carrying means and providing on each of said exercise cards a name and graphic representation of an exercise and instructions for completing said exercise, the purpose of said exercise, the technique required to perform said exercise, training advice to maximize the benefit of said exercise, variations of said exercise, and one or more cross references to one or more corresponding machine-aided exercises; planning an exercise workout focusing on one or more specific muscle groups or the cardiopulmonary system; transferring said exercise plan to said exercise cards by selecting those cards reflecting the chosen exercise plan to constitute an exercise session; inserting said selected exercise cards into a readily accessible section of said carrying means; performing an exercise session, using said selected cards, and recording the progress of said exercise regimen on said selected cards.

DETAILED DESCRIPTION OF THE PREFERRED EMBODIMENTS AND BEST MODE OF THE INVENTION

Figure 1:
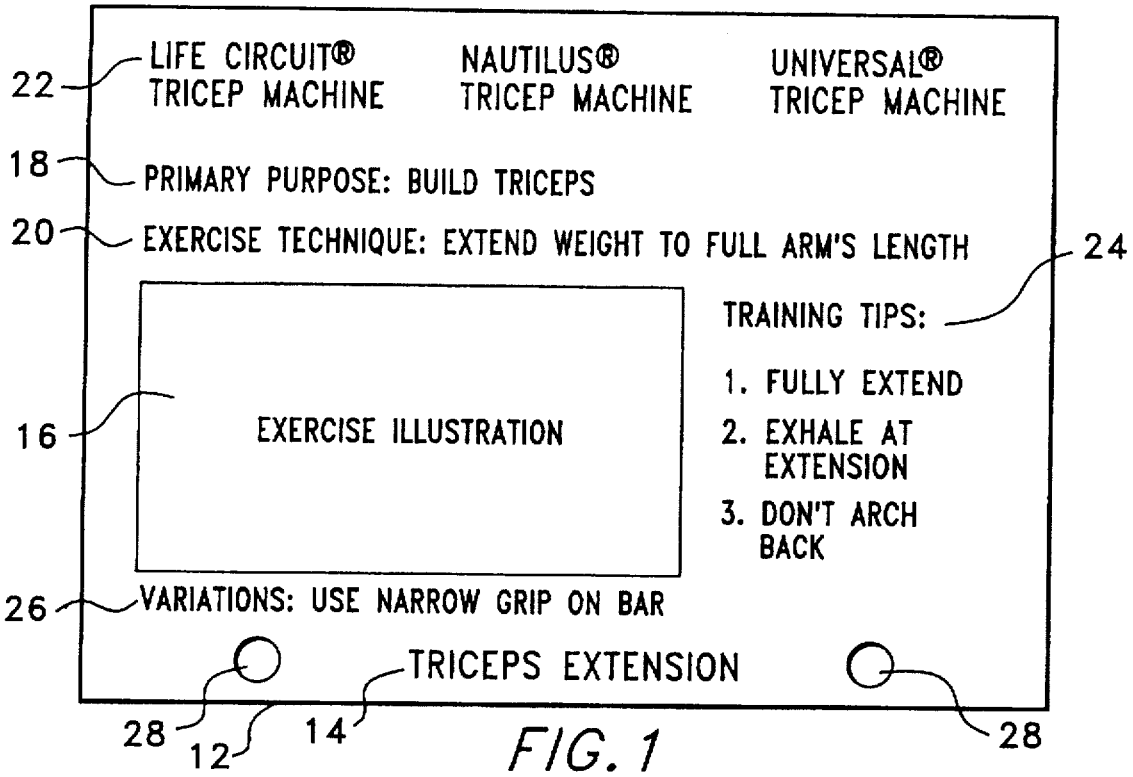
FIG. 1 is a front view of an exercise card to be used as part of the planner of the invention, showing the face side.

In the exercise planner of the present invention, primary exercise information is given to the user of the planner by means of an instructional text that instructs the user on basic principles of fitness, cautions about exercise, certain key points of what to do and what not to do, and from a set of exercise cards. An exemplary exercise card is illustrated at FIG. 1. The card itself is generally shown at 12. Typically, such cards will be of approximately four inches in height by six inches in width, although any other size convenient for carrying by hand or adapted to be inserted in the different types of carrying cases and means described below can be used, and the size of the cards is not to be taken as a limitation of the invention as claimed. Similarly, the shape or outline of the card is not to be taken as limiting, either. Cards are most conveniently made of heavy duty paper, suitable cardboard, fiberboard, Bristol board or any other cellulose media that can provide a resilient printing surface upon which a highly detailed image can be clearly imprinted. Choice of such materials will depend on the need felt for a given application. In one preferred embodiment, the cards are laminated by a suitable clear flexible plastic after having been imprinted. The plastic lamination makes the cards impervious to moisture damage, and resistant to wear and tear such as becoming dog-eared or shabby after frequent use. The lamination makes the cards durable, which is a key to the portability and interchangeability of the cards, which will become a key factor for the user. Most preferably, the plastic laminate has a non-glare surface, to minimize eye strain on the user. As an alternative, certain plastics well known to those of skill in the graphic arts can be directly imprinted upon, including vinyl and Mylar®. Such cards, whether or not plastic laminated may or may not be perforated in order to be held in ring-type binders.

An exercise to be illustrated on a given card 12 is shown in an area set aside for that purpose, 14. At FIG. 1, for example, the illustrated exercise title is shown as a triceps extension, and in like fashion, the title of any other exercise could be shown on the card. It should be understood that the relative position of the exercise title 14 shown in FIG. 1 is not a limitation of the invention as claimed, and the exercise title could be laid out at any other suitable position on the card.

A given exercise is illustrated on the card in an area set aside for that purpose, 16. To illustrate an exercise, a printed graphical drawing of a figure performing the exercise can be used, or a printed photograph of a model performing the exercise can be used, either of which means is to be included in the meaning of a "description of a specific exercise" on a card as claimed. Alternatively, a holographic image can be used, which has the advantage of being able to show a model performing the exercise, who appears to go through a range of motion of the exercise when a user slowly rotates the card. The properties and manufacturing methods of holographic images are well known to those of skill in the photographic art. Specialty sets of cards can be assembled, having exercises illustrated that are particularly well suited to certain segments of the population, for example, teenagers, senior citizens, varsity athletes, professional athletes, persons recovering from physical injuries, and so forth. It should be understood that the relative position of the exercise illustration 16 shown in FIG. 1 is not a limitation of the invention as claimed, and the exercise illustration could be laid out at any other suitable position on the card.

Other information presented on exercise card 12 includes, without limitation: a description of the primary purpose of the exercise, 18; a description of the basic technique for performing the exercise, 20; information on corresponding machine-aided exercises, 22; training tips on some of the finer points of performing the exercise for maximizing the benefits of the exercise, 24; and information on minor variations of the exercise 26. Each of these respective types of information is presented on the card in an area set aside for that purpose. Again, it should be understood that the relative position of the information illustrations 18, 20, 22, 24 and 26 shown in FIG. 1 are not limitations of the invention as claimed, and each information block could be laid out at any other suitable position on the card.

There are also included a set of cards in which each card shall communicate a certain machine group, giving information about a manufacturer's group of exercise machines. Aside from the cards communicating information about a machine, the exercise cards themselves will bear information about a corresponding machine-aided exercise. The term "corresponding machine-aided exercises" shall mean one more references to certain of these proprietary commercial exercise machines that can provide muscular improvement similar to that of the basic exercise illustrated on exercise card 12. Thus, for example, the names of machines manufactured and sold under the trademarks Life Circuit®, Nautilus® and Universal® are illustrated in FIG. 1, with the intent that a user of the card could use one of the listed exercise machines to work that muscle group of the user's body, if that machine were to be available to the user at the user's work-out facility. However, since it is well known that the technology of machine-aided exercise is advancing and progressing at a very rapid pace, and that new machine designs are constantly being developed and commercialized, it should be understood that these specifically described exercise machines are not meant to constitute a limiting list, and are exemplary only. New upgrade editions of the exercise cards of the invention would be produced reflecting newly recognized exercise machines that had not necessarily been in existence when the earlier printings of such exercise cards had taken place. Additionally, when the variations on the basic exercises 26 are taken into account, there are then thousands of different exercises and combinations of exercises that can go into putting together an exercise program, reducing the liklihood of boredom setting in with an exercise program. Furthermore, this allows the user to take advantage of the principle of muscle confusion, whereby in order to seek continual improvement, the exerciser, in essence needs to confuse his muscles in order to achieve maximal continual development, rather than keep on working the same muscles in the same way, which leads to a static level and improvement ceases. By taking advantage of the variations provided, muscle confusion occurs, and the user is able to move on to higher levels of muscular development.

Figure 2:
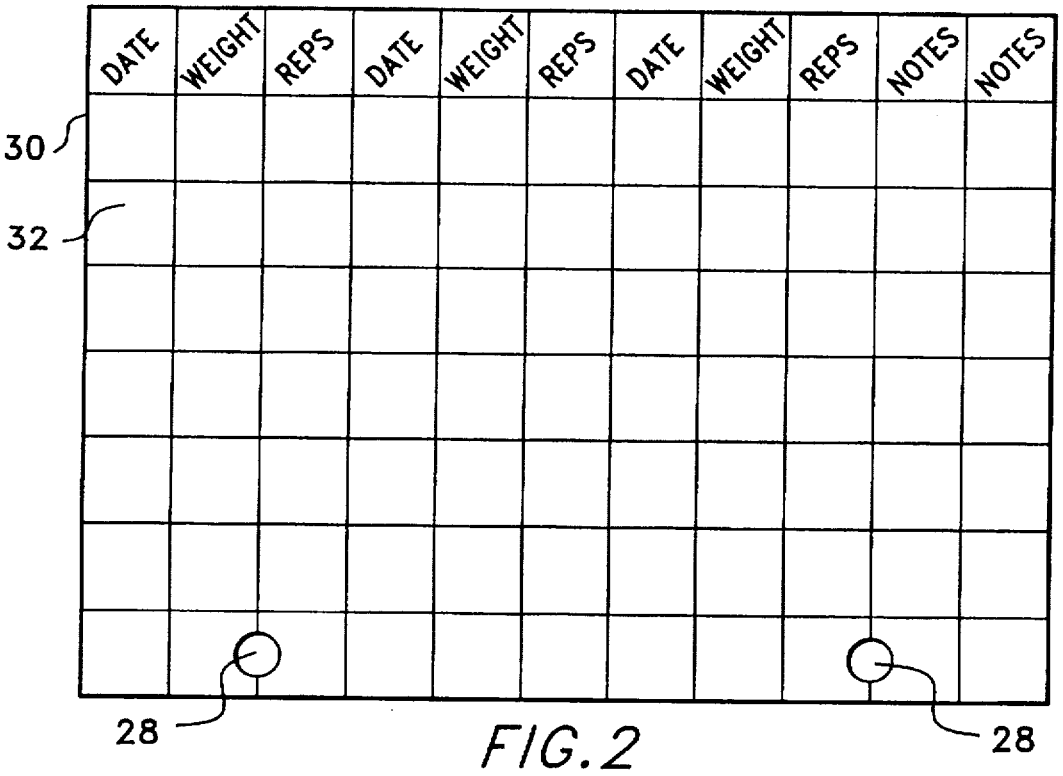
FIG. 2 is a front view of an exercise card to be used as part of the planner of the invention, showing the reverse side.

FIG. 2 shows the back side of one alternative embodiment of an exercise card 12. The back side of the card is intended to provide a place for recording the user's progress in utilization of the exercise illustrated on the other side of the card. Thus, a user can record, for example, the date on which that exercise was performed, the amount of weight used with an exercise that involved weight resistance (of course, not all of the exercises illustrated in a set of cards will involve weight training), and the number of repetitions performed that day. The user builds up a record with time that allows the user to tell at a glance how exercise work is progressing. Since the cards are preferably coated with a suitable plastic laminate, the user can write on the card grid with a writing means that is erasable, such as a grease pencil or a dry erase felt tipped marker of the type that is readily wiped off of a non-porous surface with a damp cloth. The feature of being erasable means that the card can be reused through many exercise periods or calendar periods. The user can at any time transfer such recorded results and notes to a larger diary or other permanent record that can be included in the planner, since the exercise card is designed to be a portable, temporary record.

There are additional card types that can be useful in carrying out the invention. A medical information card can be provided so that the user can record certain vital medical information about that user, such as blood type or allergies to certain medications, and include the card in the carrying means. Other cards can be prepared offering advice to the user on sound diet and nutrition, sleep habits and management of stress. Additionally, the user will be thoroughly cautioned on the necessity for receiving a physician's advice and approval before starting an exercise program. Also, a basic identification card can be provided to identify the owner of the planner, which can be inserted with the other cards or inserted into a clear plastic pocket for that purpose in the carrying means. The inclusion of such cards can provide the user with an overall, holistic approach to the total management of their health, appearance, feelings and wellness. Such additional information can also be presented in an accompanying textbook.

Another subset of cards that can be used in the invention is a set of cards anatomically illustrating major muscle groups of the body, such as, for example, musculature of the upper back and neck. Each card for a given muscle group can be color coded with a distinct tone of color. Corresponding to the chosen muscle group color, an exercise card can be imprinted with the same color if that exercise would benefit a muscle in that group. In this way, a user could tell by matching colors what exercises would benefit a muscle group the user was interested in developing. The use of such color coding enhances overall attractiveness and attention-getting aspects of the cards. Color coding further enhances the usefulness of the invention by providing quick visual comparisons and facilitates the organization and use of the cards. Group cards are quickly chosen and grouped together without having to read the text of the entire card at that time.

Figure 3:
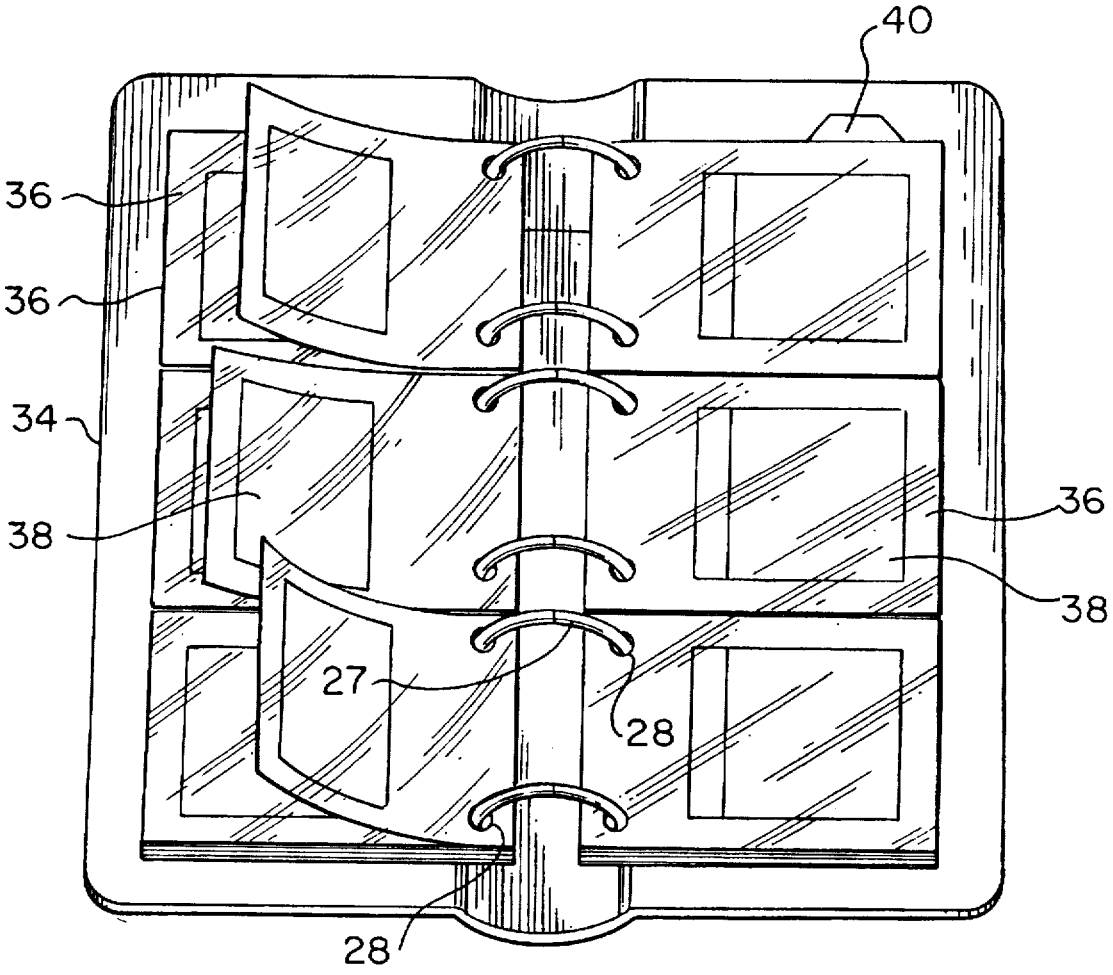
FIG. 3 is a front view of a multiple ringed binder for holding exercise cards of the invention.

Carrying means can include a ringed binder, including the familiar three-ring binder having interlocking ring segments that can open and snap closed, a bound album similar to the well known photograph album, an index card file box, or a foldable wallet having multiple panels and card slots, all of which are to be taken as being equivalent carrying means. FIG. 3 illustrates one alternative carrying means for the cards, in this case a ring binder 34, having six rings, that is shown with six card holders 36 open and facing the user. Ring binders provide a preferred means of carrying the exercise cards used in the invention, since by perforating a card at perforations 28, the cards can be directly hung onto one or more snap rings 27, in addition to being optionally inserted into card holders with transparent windows 38. Ring binders offer a variety of configurations, and can have three, four, five, six or more snap rings. FIG. 3, for example, illustrates six snap rings 27. Being able to vary the number of snap rings means that the number of exercise cards that can be laid open at one time can be varied from one or two, to six or more of such cards. The most preferred type of such a snap ring binder would be a one or two ring binder that would present the smallest possible dimensions so as to maximize portablility to and at the workout facility. As an alternative carrying means, a foldable wallet-type holder having multiple pockets in its wings can be used, of the type disclosed in U.S. Pat. No. 5,338,202, the disclosure of which is incorporated herein by reference. Such folders are well known to those of skill in the personal accessories leather working and vinyl plastic arts. Thus, for example, cards for a workout could be selected from a file box and inserted into pockets in the folding wallet, which could be held open to display the cards at the workout facility, and from which the cards could be easily removed in order to write on them.

For recording workout information on the backside of the exercise card, the planner will also provide, on a tether or in a loop, pouch or pocket, an erasable marker compatible with the plastic construction of the cards, such as a grease pencil or a dry erase felt tipped marker of the type that is readily wiped off of a non-porous surface with a damp cloth.

A tabs means 40 can be attached to one or more cards or card holders in order to aid the user in keeping track of which exercise cards have been used during a given exercise session, or in rapidly flipping back and forth between sets of cards contained in the binder.

In use, a user would decide what part or parts of their body they wanted to develop. This could be accomplished with the aid of a book on health and exercise made available with the exercise planner of the invention. After deciding what groups to work on, the user could either directly pick a selection of exercise cards, or by referring to color-coded muscle group cards, pick color-coordinated exercise cards to work out that selected muscle group. These cards are preferably stored in an index box or equivalent means. After selecting the cards, the selected cards could be inserted into the carrying means, or alternatively, if all cards were stored in the carrying means, the selected cards could be placed in a selected position or section of the carrying means. With the selected cards grouped together, the cards in the carrying means are brought to the workout area, where the workout is performed in an efficient use of time, since the workout has been planned in advance in a logical, efficient order, and the workout progress is recorded on the selected exercise cards. Future workouts can be customized to any chosen muscle group or groups, or to the cardiovascular system, by choosing subsets of cards and inserting them into the carrying means or into a section of the carrying means.

The invention provides an information display system that allows for quick access and ready comprehension of any body of information being provided. Other applications of the invention can include planning physical therapy, planning competitive events, planning medical, chiropractic or dental therapy regimens, planning woodworking or other construction projects, planning special events, gatherings, conventions and meetings, workplace projects and planning daily activities. The invention can be used by not only activity participants themselves, but also coaches, instructors, teachers, coordinators, directors, and the like, of all ages, whether children, adolescents, young adults or senior adults.

While the invention has been described with reference to particular examples and embodiments, it will be apparent that numerous variations, alternatives, and modifications are possible, and accordingly all such variations, alternatives, and modifications are to be regarded as being within the spirit and scope of the present invention. The drawings of the invention are examples only and are not to be construed as restrictions or limitations on its scope. In particular, it is contemplated that there can be wide variation in the placement of categories of information on the subset of cards included in the planner, that any equivalent means of carrying the cards in an interchangeable, transferable fashion can be employed, and that there is no restriction on the number of known exercises that can be communicated with the planner. It is intended, therefore, that the invention be limited only by the scope of the claims which follow, rather than the specific embodiments shown and described, and that such claims be interpreted as broadly as possible and consistent with the extent to which the progress in the art has been advanced by the invention.

What is claimed is:

1. A portable exercise management planner, comprising:

(a) a binder carrying means;

(b) a plurality of muscle group cards each describing a specific muscle group, each such muscle group being graphically identified by a particular color tone, and each such card comprised of laminated plastic and perforated so as to fit into the binder carrying means; and (c) a plurality of separate individual exercise cards, each bearing a description of a specific exercise and instructions for completing said exercise, each such card being graphically identified by a particular color tone corresponding to the same color tone of the appropriate said muscle group cards, and each such card being comprised of laminated plastic and perforated so as to fit into the binder carrying means.

2. The planner as claimed in claim 1, wherein said binder carrying means enables a user thereof to selectively remove, insert, transfer, and organize said muscle group cards and said exercise cards in any chosen order of presentation.

3. The planner as claimed in claim 1, wherein each of said muscle group cards and each of said exercise cards is adapted to fit into said binder carrying means in any order desired by a user of said planner.

4. The planner as claimed in claim 1, wherein each of said exercise cards has at least one surface that can be written upon and readily erased to enable a user thereof to record their progress through an exercise program and to record notes upon.

5. The planner as claimed in claim 1, wherein each of said exercise cards additionally bears a description of the purpose of said exercise.

6. The planner as claimed in claim 1, wherein each of said exercise cards additionally bears a description of the most preferred technique to perform said exercise.

7. The planner as claimed in claim 1, wherein each of said exercise cards additionally bears training advice to maximize the benefits of said exercise.

8. The planner as claimed in claim 1, wherein each of said exercise cards additionally bears a description of variations of said exercise.

9. The planner as claimed in claim 1, wherein each of said exercise cards additionally bears one or more cross references to one or more corresponding machine-aided exercises.

10. The planner as claimed in claim 1, wherein each of said exercise cards additionally bears a grid for charting the progress, as a function of time, of completion of repetitions and of weight resistance employed, of the exercise shown on said exercise card.

11. The planner as claimed in claim 1, wherein each of said exercise cards additionally bears an erasable grid for charting the progress, as a function of time, of increasing weight resistance used in the exercise shown on said exercise card, charting notes or charting diary entries.

12. The planner as claimed in claim 1, wherein said binder carrying means is a binder having one or more closable rings.

13. The planner as claimed in claim 1, wherein said exercise and muscle group cards have a non-glare surface.

14. The planner as claimed in claim 1, wherein said description of a specific exercise and instructions for completing said exercise include a holographic picture that enables a user thereof to observe the exercise being performed through multiple positions when the user moves said exercise card.

15. The planner as claimed in claim 1, additionally comprising at least one card bearing identification and medical information about the user of said planner.

16. The planner as claimed in claim 1, additionally comprising at least one card bearing information of benefit to the user of said planner concerning one or more of the topics of nutrition, sleep, or stress management.

17. A portable exercise management planner, comprising:

(a) a binder carrying means;

(b) a plurality of muscle group cards each describing a specific muscle group, each such muscle group being graphically identified by a particular color tone, and each such card comprised of laminated plastic, perforated, and adapted to fit into said binder carrying means in such a manner to enable a user thereof to selectively remove, insert, transfer, and organize said muscle group cards in any chosen order of presentation;

(c) a plurality of exercise cards, each bearing a description of a specific exercise and instructions for completing said exercise, each such card being graphically identified by a particular color tone corresponding to the same color tone of the appropriate said muscle group cards, each such card comprised of laminated plastic, perforated, and adapted to fit into said binder carrying means in such a manner to enable a user thereof to selectively remove, insert, transfer, and organize said exercise cards in any chosen order of presentation, and each such card having at least one surface that can be written upon and readily erased to enable a user thereof to record their progress through an exercise program.

18. An exercise management method, comprising the steps of:

(a) providing a binder carrying means;

(b) providing a plurality of muscle group cards each describing a specific muscle group, each such muscle group being graphically identified by a particular color tone, and each such card comprised of laminated plastic and perforated so as to fit into the binder carrying means in any order desired by a user thereof;

(c) providing a plurality of exercise cards, each describing a specific exercise, each such card being graphically identified by a particular color tone corresponding to the same color tone of the appropriate said muscle group cards, and each such card comprised of laminated plastic and perforated so as to fit into the binder carrying means in any order desired by a user thereof, and providing on each of said exercise cards a name and graphic representation of an exercise and instructions for completing said exercise, the purpose of said exercise, the technique required to perform said exercise, training advice to maximize the benefit of said exercise, variations of said exercise, one or more cross references to one or more corresponding machine-aided exercises, and a diary section to record the progress of said exercise;

(d) planning an exercise workout focusing on one or more specific muscle groups or the cardiopulmonary system;

(e) transferring said exercise plan to said exercise cards by selecting those cards reflecting the chosen exercise plan to constitute an exercise session;

(f) inserting said selected exercise cards into a readily accessible section of said binder carrying means;

(g) performing an exercise session, using said selected cards, and recording the progress of said exercise regimen on said selected cards; and (h) recording results of said exercise session on said card diary section.

19. A portable exercise management planner, comprising:

(a) a binder carrying means;

(b) a plurality of muscle group cards, each such muscle group being graphically identified by a particular color tone, and each such card comprised of laminated plastic and perforated so as to fit into the binder carrying means in any order desired by a user of said planner;

(c) a plurality of exercise cards, each bearing a name of an exercise, a holographic picture that enables a user thereof to observe said exercise being performed through multiple positions when the user moves said exercise card, instructions for completing said exercise, the purpose of said exercise, the technique required to perform said exercise, training advice to maximize the benefit of said exercise, variations of said exercise, one or more cross references to one or more corresponding machine-aided exercises, and a diary section to record the progress of said exercise, each such card being graphically identified by a particular color tone corresponding to the same color tone of the appropriate said muscle group cards, each such card comprised of laminated plastic and perforated so as to fit into the binder carrying means in any order desired by a user of said planner, and each such card having at least one surface that can be written upon and readily erased to enable a user thereof to record their progress through an exercise program.

20. An exercise management method, comprising the steps of:

(a) providing a binder carrying means;

(b) providing a plurality of muscle group cards each describing a specific muscle group, each such muscle group being graphically identified by a particular color tone, and each such card comprised of laminated plastic and perforated so as to fit into the binder carrying means in any order desired by a user thereof;

(c) providing a plurality of exercise cards, each describing a specific exercise, each such card being graphically identified by a particular color tone corresponding to the same color tone of the appropriate said muscle group cards, and each such card comprised of laminated plastic and perforated so as to fit into the binder carrying means in any order desired by a user thereof, and providing on each of said exercise cards a name of an exercise, a holographic picture that enables a user thereof to observe said exercise being performed through multiple positions when the user moves said exercise card, instructions for completing said exercise, the purpose of said exercise, the technique required to perform said exercise, training advice to maximize the benefit said exercise, variations of said exercise, one or more cross references to one or more corresponding machine-aided exercises, and a diary section to record the progress of said exercise;

(d) planning an exercise workout focusing on one or more specific muscle groups or the cardiopulmonary system;

(e) transferring said exercise plan to said exercise cards by selecting those cards reflecting the chosen exercise plan to constitute an exercise session;

(f) inserting said selected exercise cards into a readily accessible section of said binder carrying means;

(g) performing an exercise session, using said selected cards, including said holographic picture that enables a user thereof to observe an exercise being performed through multiple positions when the user moves said card, and recording the progress of said exercise regimen on said selected cards; and (h) recording results of said exercise session on said card diary section.

* * * * *